US011276342B2

(12) United States Patent
Kim et al.

(10) Patent No.: US 11,276,342 B2
(45) Date of Patent: Mar. 15, 2022

(54) DEVICE AND METHOD FOR DRIVING DISPLAY

(71) Applicant: SILICON WORKS CO., LTD., Daejeon (KR)

(72) Inventors: Do Seok Kim, Daejeon (KR); Hyun Mo Yang, Daejeon (KR); Young Gi Kim, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/218,688

(22) Filed: Mar. 31, 2021

(65) Prior Publication Data

US 2021/0312850 A1 Oct. 7, 2021

(30) Foreign Application Priority Data

Apr. 2, 2020 (KR) ..... 10-2020-0040389

(51) Int. Cl.
*G09G 3/20* (2006.01)

(52) U.S. Cl.
CPC ... *G09G 3/2003* (2013.01); *G09G 2300/0452* (2013.01); *G09G 2310/027* (2013.01); *G09G 2320/0242* (2013.01); *G09G 2320/0285* (2013.01)

(58) Field of Classification Search
CPC ..... G09G 3/2003; G09G 2320/0242; G09G 2320/0285; G09G 2310/027; G09G 2300/0452
See application file for complete search history.

(56) References Cited

U.S. PATENT DOCUMENTS

| | | | | |
|---|---|---|---|---|
| 10,339,881 | B1 * | 7/2019 | Tung | G09G 3/3607 |
| 2019/0066608 | A1 * | 2/2019 | Watanabe | G09G 3/3607 |
| 2020/0098334 | A1 * | 3/2020 | Ji | G09G 3/2074 |
| 2020/0265791 | A1 * | 8/2020 | Gao | G09G 3/3696 |

FOREIGN PATENT DOCUMENTS

KR 10-1623582 B1 5/2016

* cited by examiner

*Primary Examiner* — Andrew Sasinowski

(74) *Attorney, Agent, or Firm* — Harness, Dickey & Pierce, P.L.C.

(57) ABSTRACT

A display driving device capable of performing overdriving compensation for image data using a comparison result between pixel data of a previous sub-pixel and pixel data of a current sub-pixel in units of horizontal lines includes overdriving controller configured to generate overdriving pixel data for a current sub-pixel based on a result of comparison between first pixel data for a previous sub-pixel and second pixel data for the current sub-pixel and a color arrangement pattern of the previous sub-pixel and the current sub-pixel in units of horizontal lines of image data, and a data driver configured to generate a source signal for the current sub-pixel based on one of the second pixel data and the overdriving pixel data to supply the source signal to the current sub-pixel.

17 Claims, 9 Drawing Sheets

FIG. 3

| | | | | | | | | | | |
|---|---|---|---|---|---|---|---|---|---|---|
| L1 | R1_1 | G1_1 | B1_1 | R1_2 | G1_2 | B1_2 | R1_3 | G1_3 | B1_3 | |
| L2 | | R2_1 | G2_1 | B2_1 | R2_2 | G2_2 | B2_2 | R2_3 | G2_3 | B2_3 |
| L3 | R3_1 | G3_1 | B3_1 | R3_2 | G3_2 | B3_2 | R3_3 | G3_3 | B3_3 | |
| L4 | | R4_1 | G4_1 | B4_1 | R4_2 | G4_2 | B4_2 | R4_3 | G4_3 | B4_3 |

FIG. 4A

| | | First pixel data | | | | | | | | |
|---|---|---|---|---|---|---|---|---|---|---|
| | | 0 | 32 | 64 | 96 | 128 | 160 | 192 | 224 | 255 |
| Second pixel data | 0 | 0 | | 0 | 0 | 0 | 0 | 0 | 0 | 0 |
| | 32 | 40 | 32 | 24 | 16 | 0 | 0 | 0 | 0 | 0 |
| | 64 | 80 | 73 | 64 | 56 | 48 | 40 | 32 | 24 | 16 |
| | 96 | 120 | 112 | 104 | 96 | 88 | 80 | 72 | 64 | 56 |
| | 128 | 160 | 152 | 144 | 136 | 128 | 120 | 112 | 104 | 96 |
| | 160 | 200 | 192 | 184 | 176 | 168 | 160 | 152 | 144 | 136 |
| | 192 | 240 | 232 | 224 | 216 | 208 | 200 | 192 | 184 | 176 |
| | 224 | 255 | 255 | 254 | 255 | 248 | 240 | 232 | 224 | 216 |
| | 255 | 255 | 255 | 255 | 255 | 255 | 255 | 255 | 255 | 255 |

112

| | | First pixel data | | | | | | | | |
|---|---|---|---|---|---|---|---|---|---|---|
| | | 0 | 32 | 64 | 96 | 128 | 160 | 192 | 224 | 255 |
| Second pixel data | 0 | 0 | 0 | 0 | 0 | 0 | 0 | 0 | 0 | 0 |
| | 32 | 40 | 32 | 24 | 16 | 0 | 0 | 0 | 0 | 0 |
| | 64 | 80 | 73 | 64 | 56 | 48 | 40 | 32 | 24 | 16 |
| | 96 | 120 | 112 | 104 | 96 | 88 | 80 | 72 | 64 | 56 |
| | 128 | 160 | 152 | 144 | 136 | 128 | 120 | 112 | 104 | 96 |
| 176 | 160 | 200 | 192 | 184 | 176 | 168 | 160 | 152 | 144 | 136 |
| | 192 | 240 | 232 | 224 | 216 | 208 | 200 | 192 | 184 | 176 |
| | 224 | 255 | 255 | 254 | 255 | 248 | 240 | 232 | 224 | 216 |
| | 255 | 255 | 255 | 255 | 255 | 255 | 255 | 255 | 255 | 255 |

FIG. 6

| | | First pixel data | | | | | | | | |
|---|---|---|---|---|---|---|---|---|---|---|
| | | 0 | 32 | 64 | 96 | 128 | 160 | 192 | 224 | 255 |
| Second pixel data | 0 | 0 | 0 | 0 | 0 | 0 | 0 | 0 | 0 | 0 |
| | 32 | 40 | 32 | 24 | 16 | 0 | 0 | 0 | 0 | 0 |
| | 64 | 80 | 73 | 64 | 56 | 48 | 40 | 32 | 24 | 16 |
| | 96 | 120 | 112 | 104 | 96 | 88 | 80 | 72 | 64 | 56 |
| | 128 | 160 | 152 | 144 | 136 | 128 | 120 | 112 | 104 | 96 |
| | 160 | 200 | 192 | 184 | 176 | 168 | 160 | 152 | 144 | 136 |
| | 192 | 240 | 232 | 224 | 216 | 208 | 200 | 192 | 184 | 176 |
| | 224 | 255 | 255 | 254 | 255 | 248 | 240 | 232 | 224 | 216 |
| | 255 | 255 | 255 | 255 | 255 | 255 | 255 | 255 | 255 | 255 |

D3 D2 D1

DEVICE AND METHOD FOR DRIVING DISPLAY

CROSS-REFERENCE TO RELATED APPLICATIONS

This application claims the benefit of the Korean Patent Application No. 10-2020-0040389 filed on Apr. 2, 2020 which is hereby incorporated by reference as if fully set forth herein.

FIELD

The present specification relates to a display device, and more specifically, to a device for driving a display and a method for driving a display.

BACKGROUND

As an information society develops, demands for display devices which display images are increasing in various forms. In response to this demand, various types of display devices such as an organic light emitting display (OLED) device as well as a conventional liquid crystal display (LCD) device are used.

When the display device displays an image, the brightness of each pixel is determined according to a source signal supplied through a data line connected to each pixel. However, when there is parasitic capacitance in the data line or each pixel, or when a constituent material of each pixel has a delay characteristic, a delay can occur until the brightness of each pixel changes according to a source signal. When this delay occurs in the display device, since the display device cannot express a desired color and luminance, the quality of an image can be degraded.

For example, in the case of a liquid crystal display device, as the liquid crystal state of each pixel changes according to the source signal supplied to each pixel, the brightness of the pixel changes, and the change in the brightness of the pixel can be delayed by a slow response speed of the liquid crystal.

In order to solve the above-described problem, an overdriving compensation method for reducing delay by compensating a source signal according to a change in an image displayed on the display device has been proposed. A general overdriving compensation method compares previous frame data and current frame data, and compensates the pixel data of the corresponding frame for each frame according to the comparison result.

Since continuous frame data is compared, the general overdriving compensation method is applicable only when the image is a video. However, even in the case of a still image composed of a single frame, since a delay can occur until the brightness of the pixel changes in the frame, application of an overdriving method is required, but since the general overdriving compensation method is based on the comparison result of frame data, there is a limitation in that the general overdriving compensation method cannot be applied for the still image.

Further, in the case of determining a compensation value for each sub-pixel included in each frame in the general overdriving compensation method, when a separate lookup table is used for each color of each sub-pixel, there is a problem in that manufacturing costs and size of the display device can increase. Also, if one common lookup table is used, when a color change of a display panel occurs, the compensation value cannot be selectively determined for a sub-pixel of a specific color, and thus there is a problem in that accurate compensation is not performed.

SUMMARY

Accordingly, the present disclosure is directed to providing a display driving device and a display driving method capable of performing overdriving compensation for image data using a comparison result between pixel data of a previous sub-pixel and pixel data of a current sub-pixel in units of horizontal lines.

Further, the present disclosure is directed to providing a display driving device and a display driving method capable of correcting a compensation value on a lookup table according to a color arrangement pattern of a previous sub-pixel and a current sub-pixel.

In addition, the present disclosure is directed to providing a display driving device and a display driving method capable of applying different weights to the compensation value on a lookup table according to a difference value between pixel data of a previous sub-pixel and pixel data of a current sub-pixel.

According to an aspect of the present disclosure, there is provided a display driving device including an overdriving controller configured to generate overdriving pixel data for a current sub-pixel based on a result of comparison between first pixel data for a previous sub-pixel and second pixel data for the current sub-pixel and a color arrangement pattern of the previous sub-pixel and the current sub-pixel in units of horizontal lines of image data, and a data driver configured to generate a source signal for the current sub-pixel based on one of the second pixel data and the overdriving pixel data to supply the source signal to the current sub-pixel.

According to another aspect of the present disclosure, there is provided a method of driving a display including comparing first pixel data for a previous sub-pixel and second pixel data for a current sub-pixel in units of horizontal lines of image data to determine whether to overdrive the current sub-pixel, generating overdriving pixel data for the current sub-pixel based on a compensation value and a color arrangement pattern of the previous sub-pixel and the current sub-pixel when it is determined to overdrive the current sub-pixel, the compensation value being determined by using a value mapped to the first pixel data and the second pixel data on a lookup table, and converting one of the second pixel data and the overdriving pixel data to a source signal and outputting the source signal to the current sub-pixel.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings:

FIG. 3 is a diagram conceptually illustrating a method in which a compensation value calculation unit according to the present disclosure compares a previous sub-pixel on a previous horizontal line and a current sub-pixel on a current horizontal line;

FIG. 4A is a diagram illustrating one example in which the compensation value calculation unit according to the present disclosure determines an overdriving compensation value of the current sub-pixel;

FIG. 6 is a diagram conceptually illustrating a method in which the overdriving pixel data generator shown in FIG. 2 sets different weights according to a difference value between pixel data;

DETAILED DESCRIPTION

Figure 1:
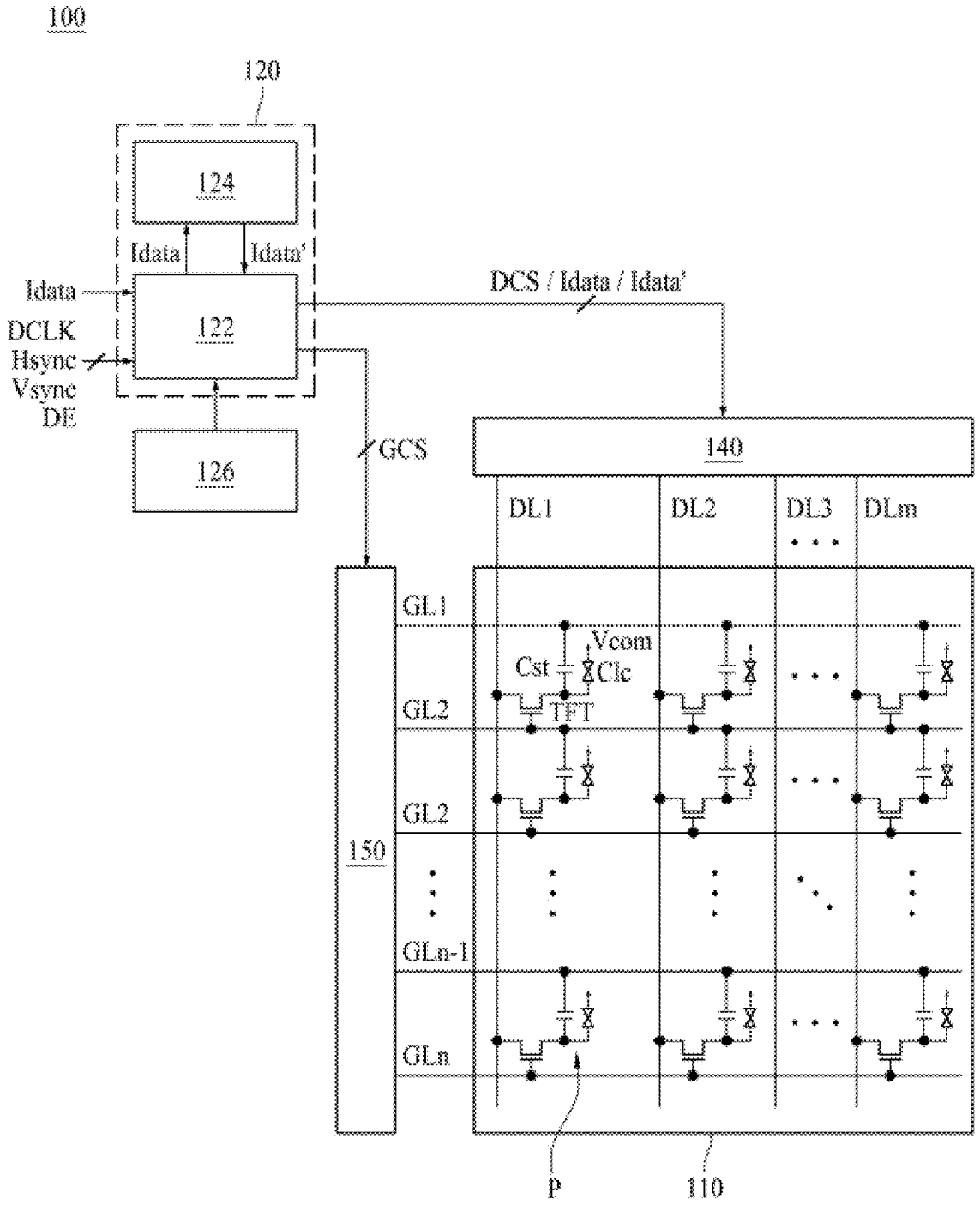
FIG. 1 is a diagram illustrating a configuration of a display system to which a display driving device according to one embodiment of the present disclosure is applied.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of this specification will be described in detail with reference to the accompanying drawings.

FIG. 1 is a diagram illustrating a configuration of a display system to which a display driving device according to one embodiment of the present disclosure is applied.

As shown in FIG. 1, a display system 100 to which the display driving device according to one embodiment of the present disclosure is applied includes a display panel 110, a display driving device 120, a data driver 140, and a gate driver 150.

The display panel 110 includes a plurality of gate lines GL1 to GLn, a plurality of data lines DL1 to DLm, and pixels P respectively provided in a plurality of pixel regions. The plurality of gate lines GL1 to GLn and the plurality of data lines DL1 to DLm are arranged to cross each other to define the plurality of the pixel regions. The plurality of gate lines GL1 to GLn may be arranged in a lateral direction and the plurality of data lines DL1 to DLm may be arranged in a vertical direction, but are not limited thereto.

In one embodiment, the display panel 110 may be a liquid crystal display (LCD) panel. When the display panel 110 is a liquid crystal display panel, the display panel 110 includes a thin film transistor TFT and liquid crystal cells connected to the thin film transistor TFT. The thin film transistor TFT is formed in the pixel regions defined by the plurality of gate lines GL1 to GLn and the plurality of data lines DL1 to DLm.

The thin film transistor TFT supplies a data signal supplied through each of the data lines DL1 to DLm to the liquid crystal cell in response to a scan pulse supplied through each of the gate lines GL1 to GLn.

The liquid crystal cell is composed of common electrodes and sub-pixel electrodes connected to the thin film transistor TFT. The common electrodes and the sub-pixel electrodes are facing each other with a liquid crystal therebetween. Thus, the liquid crystal cell may be equivalently represented as a liquid crystal capacitor Clc. The liquid crystal cell includes a storage capacitor Cst connected to a previous gate line to maintain the data signal charged in the liquid crystal capacitor Clc until the next data signal is charged.

Meanwhile, the pixel regions of the display panel 110 may be composed of red (R), green (G), and blue (B) sub-pixels.

In one embodiment, the sub-pixels may be repeatedly disposed in an order of red, green, and blue within one horizontal line. In this case, in two adjacent horizontal lines, two sub-pixels connected to the same data line may have different color. To this end, a last sub-pixel among sub-pixels in a first horizontal line is set as a dummy pixel and a first sub-pixel among sub-pixels in a second horizontal line adjacent to the first horizontal line is set as a dummy pixel, and thus, two sub-pixels having different colors may be connected to the same data line in the first and second horizontal lines.

In the above-described embodiment, a case in which the display panel 110 is the liquid crystal display panel is described, but the display panel 110 may also be an organic light emitting diode (OLED) panel in which three color sub-pixels are formed in each pixel region.

Further, in the above-described embodiment, a case in which the display panel 110 is composed of the three-color sub-pixels is described, but in another embodiment, the display panel 110 may also be composed of red (R), green (G), blue (B), and white (W) sub-pixels.

The display driving device 120 drives the display panel 110 and includes a timing controller 122 and an overdriving controller 124.

The timing controller 122 receives various timing signals including a vertical synchronization signal Vsync, a horizontal synchronization signal Hsync, a data enable signal DE, and a clock signal CLK from an external system (not shown) to generate a data control signal DCS which controls the data driver 140 and a gate control signal GCS which controls the gate driver 150.

In one embodiment, the data control signal DCS may include a source start pulse (SSP), a source sampling clock (SSC), a source output enable signal, and the like, and the gate control signal GCS may include a gate start pulse (GSP), a gate shift clock (GSC), a gate output enable signal, and the like.

Here, the source start pulse controls data sampling start timing of one or more source driver integrated circuits (ICs) (not shown) constituting the data driver 140. The source sampling clock is a clock signal which controls sampling timing of data in each of the source driver ICs. The source output enable signal controls output timing of the data driver 140.

The gate start pulse controls operation start timing of one or more gate driver integrated circuits (ICs) (not shown) constituting the gate driver 150. The gate shift clock is a clock signal which is commonly input to the one or more gate driver ICs, and controls shift timing of the scan signal (gate pulse). The gate output enable signal specifies timing information of the one or more gate driver ICs.

Further, the timing controller 122 according to the present disclosure transmits image data Idata received from the external system to the overdriving controller 124. The timing controller 122 receives pixel data Idata or overdriving pixel data Idata' corresponding to the image data from the overdriving controller 124 and converts the pixel data Idata or overdriving pixel data Idata' to a data having format which may be processed by the data driver 140 to output the converted data to the data driver 140.

The overdriving controller 124 determines whether to overdrive the current sub-pixel by comparing the previous sub-pixel and the current sub-pixel in units of horizontal lines of the image data. When it is determined to overdrive the current sub-pixel, the overdriving controller 124 generates the overdriving pixel data for the current sub-pixel.

In one embodiment, according to the present disclosure, when generating the overdriving pixel data for the current sub-pixel, the overdriving controller 124 may generate the overdriving pixel data for the current sub-pixel based on a color arrangement pattern of the previous sub-pixel and the current sub-pixel.

Hereinafter, a configuration of the overdriving controller 124 according to the present disclosure will be more specifically described with reference to FIG. 2.

Figure 2:
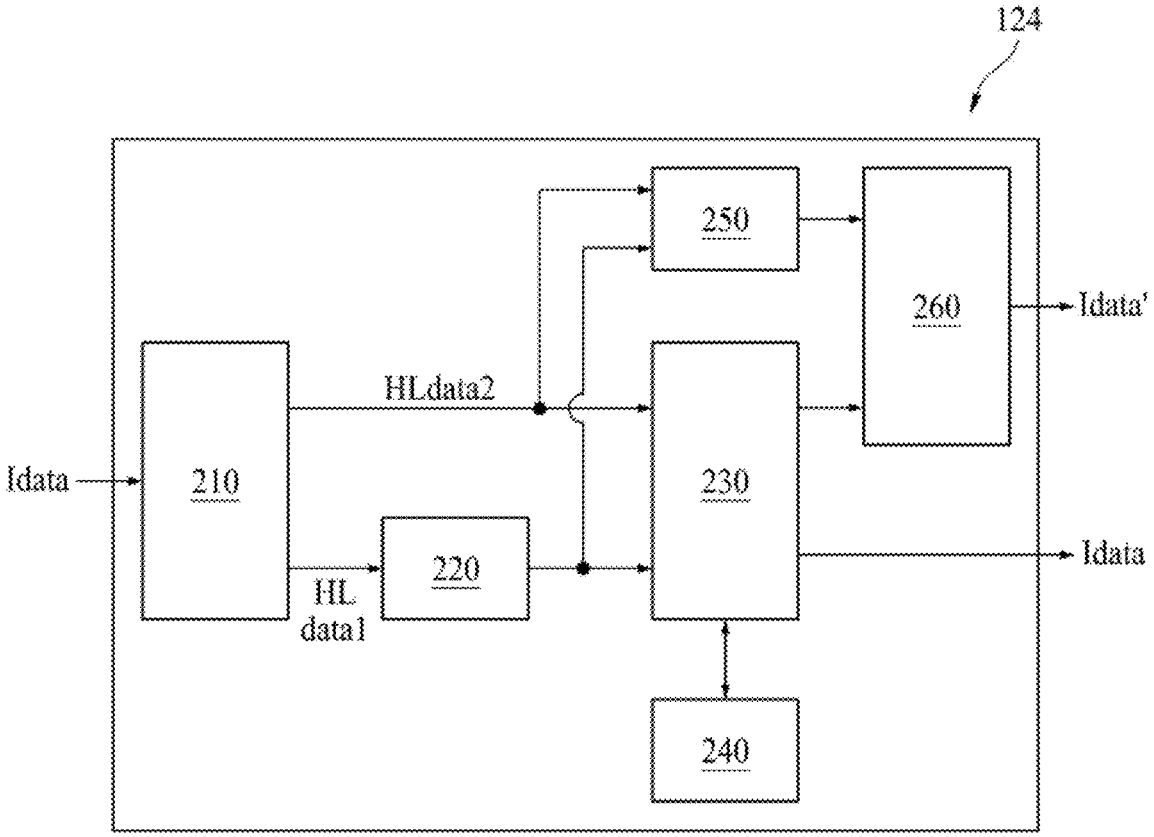
FIG. 2 is a block diagram schematically illustrating a configuration of an overdriving controller according to one embodiment of the present disclosure.

FIG. 2 is a block diagram schematically illustrating the configuration of the overdriving controller according to one embodiment of the present disclosure is applied. As shown in FIG. 2, the overdriving controller 124 according to one embodiment of the present disclosure includes an image data receiver 210, a line memory 220, a compensation value calculation unit 230, a lookup table 240, a correction determination unit 250, and an overdriving pixel data generator 260.

The image data receiver 210 receives image data from the timing controller 122 or the external system. In one embodiment, the image data receiver 210 may receive a still image as image data. The image data receiver 210 classifies the received image data in units of the horizontal lines, and outputs horizontal line data, which is image data for one horizontal line, to the line memory 220, the compensation value calculation unit 230, and the correction determination unit 250.

In another embodiment, the image data receiver 210 may also receive a moving image composed of a plurality of frames as image data. According to this embodiment, the image data receiver 210 may receive the image data in frame units or receive the moving image from the timing controller 122 or the external system and then may classify the image data or the moving image for each frame to store in a separate frame memory (not shown), and may classify the frames in units of the horizontal lines to store in the line memory 220.

The line memory 220 stores horizontal line data output from the image data receiver 210. In one embodiment, the line memory 220 may store one horizontal line data output from the image data receiver 210 until the next horizontal line data is input.

According to this embodiment, when horizontal line data HLdata2 for a current horizontal line is output from the image data receiver 210 to the compensation value calculation unit 230 and the correction determination unit 250, the line memory 220 outputs a previously stored horizontal line data HLdata1 for previous horizontal line to the compensation value calculation unit 230 and the correction determination unit 250.

The compensation value calculation unit 230 compares the horizontal line data for the current horizontal line and the horizontal line data for the previous horizontal line to determine whether to overdrive the current sub-pixel included in the current horizontal line. When it is determined to overdrive the current sub-pixel, the compensation value calculation unit 230 determines a compensation value for overdriving the current sub-pixel.

Specifically, the compensation value calculation unit 230 compares first pixel data for the previous sub-pixel included in the previous horizontal line and second pixel data for the current sub-pixel included in the current horizontal line, and calculates a difference value between the first pixel data and the second pixel data. In this case, the previous sub-pixel and the current sub-pixel refer to pixels connected to the same data line in the previous horizontal line and the current horizontal line.

For example, as shown in FIG. 3, when a first horizontal line L1 is the previous horizontal line and a second horizontal line L2 is the current horizontal line, the compensation value calculation unit 230 compares the first pixel data for a previous sub-pixel G1_1 included in the previous horizontal line L1 and the second pixel data for a current sub-pixel R2_1 included in the current horizontal line L2 to calculate the difference value.

When the calculated difference value is smaller than or equal to a threshold value, the compensation value calculation unit 230 determines not to overdrive the current sub-pixel, and thus outputs the second pixel data Idata to the timing controller 122.

Meanwhile, when the calculated difference value is greater than the threshold value, the compensation value calculation unit 230 determines to overdrive the current sub-pixel, and determines the compensation value for overdriving the current sub-pixel using the lookup table 240.

In one embodiment, when it is determined to overdrive the current sub-pixel, the compensation value calculation unit 230 may determine values mapped to the first pixel data for the previous sub-pixel and the second pixel data for the current sub-pixel on the lookup table 240 as the compensation values for overdriving the current sub-pixel.

For example, as shown in FIG. 4A, when the first pixel data for the previous sub-pixel is 32, the second pixel data for the current sub-pixel is 64, and the threshold value is 0, since the difference value between the first pixel data and the second pixel data is 32 which is greater than the threshold value, the compensation value calculation unit 230 determines to overdrive the current sub-pixel. Further, it is determined that the compensation value for the current sub-pixel is a value 73 for a point where a value 32 for the first pixel data and a value 64 for the second pixel data cross on the lookup table 240.

Meanwhile, when there are no the values for the first pixel data and the second pixel data in the lookup table 240, the compensation value calculation unit 230 may determine values mapped to the first pixel data and the second pixel data using an interpolation method. That is, the compensation value calculation unit 230 may determine the compensation value for the current sub-pixel using values mapped to pixel data adjacent to each of the first pixel data and the second pixel data on the lookup table 240.

Figure 4B:
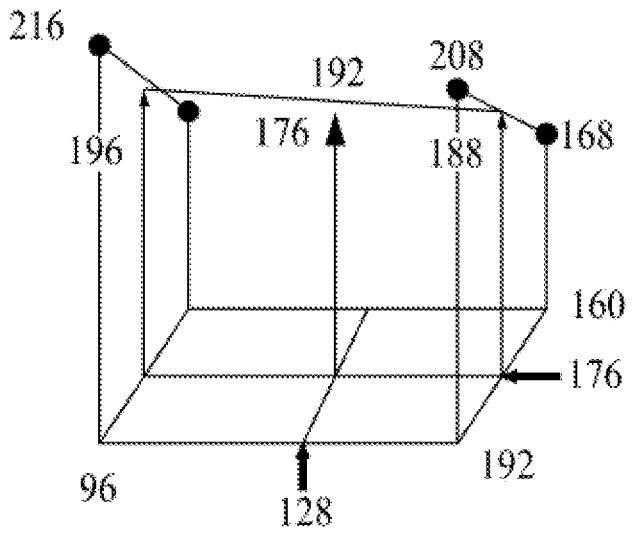
FIG. 4B is a diagram illustrating another example in which the compensation value calculation unit according to the present disclosure determines the overdriving compensation value of the current sub-pixel.

For example, as shown in FIG. 4B, when a value for the first pixel data is 112 and a value for the second pixel data is 176, there are no the value 112 for the first pixel data and the value 176 for the second pixel data on the lookup table 240. Accordingly, the compensation value calculation unit 230 may determine a compensation value for the current sub-pixel using four values 176, 168, 216, and 208. The value 176 is a value for point where a value 96 adjacent to the value 112 and a value 160 adjacent to the value 176 cross on the lookup table 240. The value 168 is a value for point where a value 128 adjacent to the value 112 and the value 160 adjacent to the value 176 cross on the lookup table 240. The value 216 is a value for point where the value 96 adjacent to the value 112 and a value 192 adjacent to the value 176 cross on the lookup table 240. The value 208 is a value for point where the value 128 adjacent to the value 112 and the value 192 adjacent to the value 176 cross on the lookup table 240.

In this case, the compensation value calculation unit 230 may calculate an average of the value 176 for the point where the value 96 and the value 160 cross and the value 216 for the point where the value 96 and the value 192 cross to obtain a value 196. The compensation value calculation unit 230 may calculate an average of the value 168 for the point where the value 128 and the value 160 cross and the value 208 for the point where the value 128 and the value 192 cross to obtain the value 188. The compensation value calculation unit 230 may calculate an average of the value 196 and the value 188 to obtain a value 192, and determine the value 192 as the compensation value for the current sub-pixel.

Referring to FIG. 2 again, in the lookup table 240, the compensation value for overdriving the current sub-pixel is mapped to the first pixel data for the previous sub-pixel included in the previous horizontal line and the second pixel data for the current sub-pixel included in the current horizontal line. In this case, in order to reduce a storage space, only compensation values corresponding to some pixel data among the first pixel data and some pixel data among the second pixel data are recorded in the look-up table 240, and the compensation values for the pixel data not recorded in the look-up table 240 are determined through the interpolation method.

The correction determination unit 250 detects a color arrangement pattern based on a color of the previous sub-pixel and a color of the current sub-pixel, and determines whether to correct the compensation value determined for the current sub-pixel based on the detected color arrangement pattern.

In one embodiment, the correction determination unit 250 confirms whether the detected color arrangement pattern corresponds to a predetermined reference color arrangement pattern, and determines to correct the compensation value for the current sub-pixel when the detected color arrangement pattern corresponds to the reference color arrangement pattern. In detail, the correction determination unit 250 determines the color arrangement pattern based on the colors of the previous sub-pixel and the current sub-pixel connected to the same data line in the previous and current horizontal lines. For example, as shown in FIG. 3, in the previous and current horizontal lines L2 and L3, since the color of the previous sub-pixel connected to a second data line is R, and the color of the current sub-pixel is G, the color arrangement pattern is determined as R-G. In this example, when the reference color arrangement pattern is R-G, the correction determination unit 250 may determine to correct the compensation values for the current sub-pixels connected to the second data line, a fifth data line, and an eighth data line in the previous and current horizontal lines L2 and L3.

The overdriving pixel data generator 260 generates the overdriving pixel data for the current sub-pixel based on the compensation value calculated the compensation value calculation unit 230 and the determination result of the correction determination unit 250. Specifically, according to the determination result of the correction determination unit 250, when the compensation value for the current sub-pixel is not required to be corrected, the overdriving pixel data generator 260 generates the compensation value calculated by the compensation value calculation unit 230 as the overdriving pixel data for the current sub-pixel.

Meanwhile, when the compensation value for the current sub-pixel is required to be corrected according to the determination result of the correction determination unit 250, the overdriving pixel data generator 260 increases or decreases the compensation value to generate the overdriving pixel data for the current sub-pixel by reflecting a predetermined weight in the compensation value calculated by the compensation value calculation unit 230.

Hereinafter, an example in which the overdriving pixel data generator 260 generates the overdriving pixel data for the current sub-pixel will be described with reference to FIGS. 4A and 5. In the following example, a case in which the threshold value is assumed to be 0 will be described.

Figure 5:
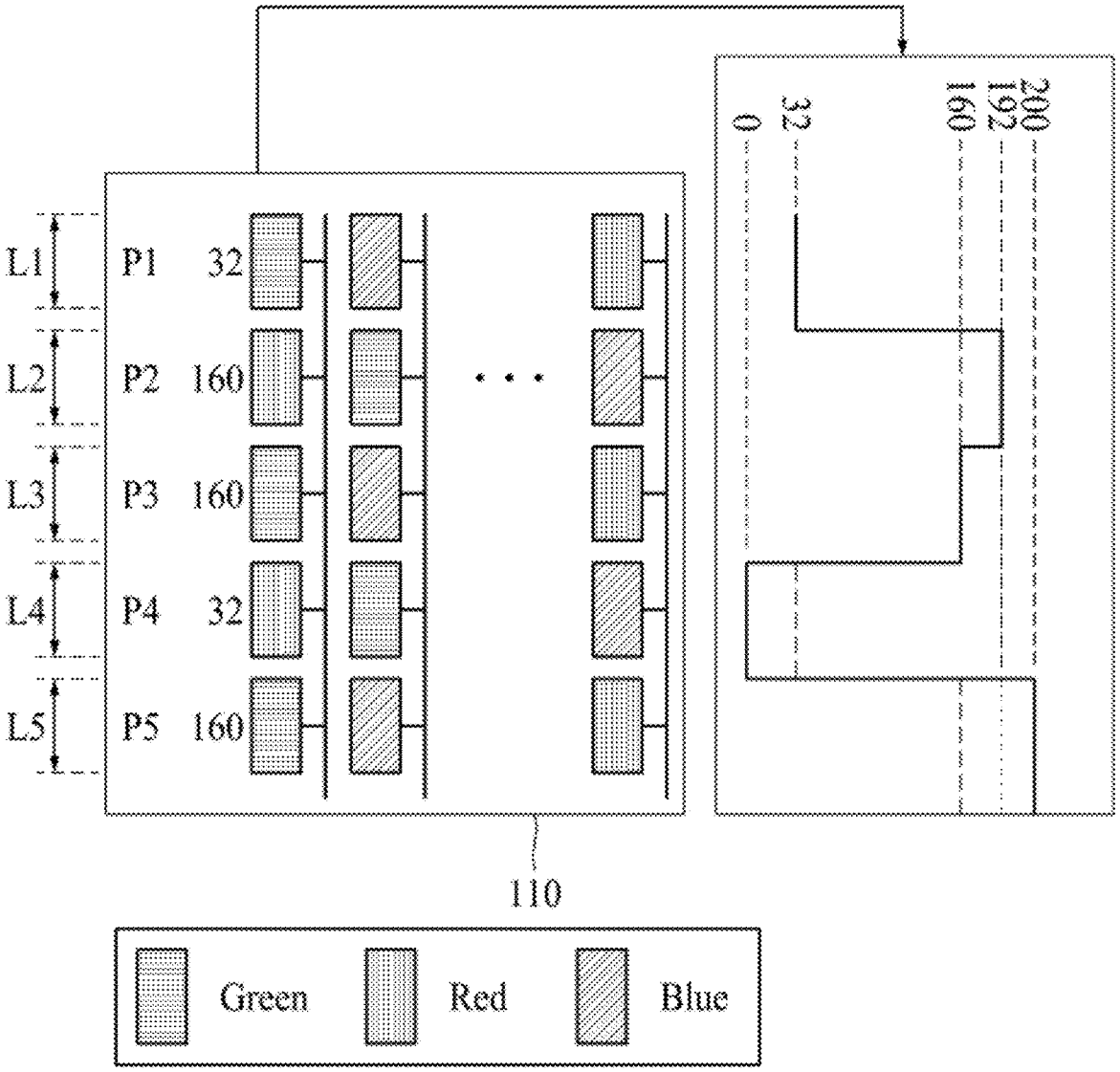
FIG. 5 is a diagram conceptually illustrating a method in which an overdriving pixel data generator according to the present disclosure generates overdriving pixel data for the current sub-pixel in units of horizontal lines.

As shown in FIG. 5, when the first horizontal line L1 is the previous horizontal line and the second horizontal line L2 is the current horizontal line, since first pixel data for a previous sub-pixel P1 is a value 32 and second pixel data for a current sub-pixel P2 is a value 160 and thus the difference value between the first pixel data and the second pixel data is greater than the threshold value, the compensation value calculation unit 230 determines to overdrive the current sub-pixel. Further, the compensation value calculation unit 230 sets a value 192, which is mapped to the value 32 for the first pixel data and the value 160 for the second pixel data on the lookup table 240 shown in FIG. 4A, as a compensation value. Further, since the color arrangement pattern of the previous sub-pixel P1 and the current sub-pixel P2 is G-R, the color arrangement pattern is different from the reference color arrangement pattern R-G and the correction determination unit 250 determines that the compensation value for the current sub-pixel is not an object to be corrected. Accordingly, the overdriving pixel data generator 260 outputs the compensation value 192 calculated by the compensation value calculation unit 230 as overdriving pixel data for the current sub-pixel, and thus, the current sub-pixel P2 emits light according to a source signal corresponding to the value 192 for the overdriving pixel data.

Meanwhile, when the second horizontal line L2 is the previous horizontal line and a third horizontal line L3 is the current horizontal line, since both first pixel data for the previous sub-pixel P2 and second pixel data for a current sub-pixel P3 are a value 160, and thus, the difference value between the first pixel data and the second pixel data is 0. Since the difference value is smaller than or equal to the threshold value, the compensation value calculation unit 230 determines not to overdrive the current sub-pixel P3. Accordingly, the compensation value calculation unit 230 outputs the value 160 for the second pixel data of the current sub-pixel P3, and the current sub-pixel P3 emits light according to a source signal corresponding to the value 160 for the second pixel data.

Further, when the third horizontal line L3 is the previous horizontal line and a fourth horizontal line L4 is the current horizontal line, since first pixel data of the previous sub-pixel P3 is a value 160 and second pixel data of a current sub-pixel P4 is a value 32 and thus the difference value between the first pixel data and the second pixel data is greater than or equal to the threshold value, the compensation value calculation unit 230 determines to overdrive the current sub-pixel. Further, the compensation value calculation unit 230 sets a value 0, which is mapped to the value 160 for the first pixel data and the value 32 for the second pixel data as an overdriving value on the lookup table 240, as a compensation value. Further, since the color arrangement pattern of the previous sub-pixel P3 and the current sub-pixel P4 is G-R, the color arrangement pattern is different from the reference color arrangement pattern R-G, and thus the correction determination unit 250 determines that the compensation value for the current sub-pixel is not an object to be corrected. Accordingly, the overdriving pixel data generator 260 outputs the compensation value 0 calculated by the compensation value calculation unit 230 as overdriving pixel data for the current sub-pixel. Accordingly, the current sub-pixel P2 emits light according to a source signal corresponding to the value 0 for the overdriving pixel data.

Further, when the fourth horizontal line L4 is the previous horizontal line and a fifth horizontal line L5 is the current horizontal line, since first pixel data for the previous sub-pixel P4 is a value 32 and second pixel data for a current sub-pixel P5 is a value 160 and thus the difference value between the first pixel data and the second pixel data is greater than or equal to the threshold value, the compensation value calculation unit 230 determines to overdrive the current sub-pixel. Further, the compensation value calculation unit 230 sets a value 192, which is mapped to the value 32 for the first pixel data and the value 160 for the second pixel data on the lookup table 240 as a compensation value. Further, since the color arrangement pattern of the previous sub-pixel P4 and the current sub-pixel P5 is R-G, and the color arrangement pattern is the same as the reference color arrangement pattern R-G, and thus the correction determination unit 250 determines that the compensation value for the current sub-pixel is an object to be corrected. Accordingly, the overdriving pixel data generator 260 outputs a value 200 in which a predetermined weight is applied to the compensation value 192 calculated by the compensation value calculation unit 230, as overdriving pixel data for the current sub-pixel P5. Accordingly, the current sub-pixel P5 emits light according to a source signal corresponding to the value 200 for the overdriving pixel data.

In one embodiment, the overdriving pixel data generator 260 may vary a weight to be applied to the compensation value for the current sub-pixel according to the difference value between the first pixel data and the second pixel data. For example, as shown in FIG. 6, the compensation values for the current sub-pixels D1 having a difference value 32 between the first pixel data and the second pixel data on the lookup table 240 may be corrected by reflecting a first weight. The compensation values for the current sub-pixels D2 having a difference value 64 between the first pixel data and the second pixel data may be corrected by reflecting a second weight. The compensation values for the current sub-pixels D3 having a difference value 96 between the first pixel data and the second pixel data may be corrected by reflecting a third weight.

According to the present disclosure, since the weight to be reflected in the compensation value according to the difference value between the first pixel data and the second pixel data is varied, and thus a correction degree of the compensation value may be changed according to the difference value between the first pixel data and the second pixel data, overdriving compensation accuracy of the current sub-pixel may be enhanced.

As described above, according to the present disclosure, the overdriving controller 124 may determine whether to overdrive the current sub-pixel based on the pixel data for the previous and current sub-pixels in units of the horizontal lines, and when the current sub-pixel is overdriven, final overdriving pixel data is generated by correcting the compensation value for the current sub-pixel based on the color arrangement pattern of the previous sub-pixel and the current sub-pixel. Accordingly, in the present disclosure, even when overdriving is performed using one common lookup table, a characteristic of each color may be reflected, and even when a color change of the display panel 110 occurs, since only a compensation value for a pixel of a corresponding color may be selectively corrected, accuracy of overdriving compensation may be enhanced.

In the above-described embodiment, although a case in which the timing controller 122 and the overdriving controller 124 are separate configurations is described, this is only an example, and the overdriving controller 124 may be included in the timing controller 122. As another example, the overdriving controller 124 may be disposed between the external system and the timing controller 122. In this case, the overdriving controller 124 may receive the image data directly from the external system, and then generate the overdriving pixel data from the image data and transmit the overdriving pixel data to the timing controller 122. In another example, the overdriving controller 124 may be disposed between the timing controller 122 and the data driver 140 to directly transmit the overdriving pixel data to the data driver 140 without passing through the timing controller 122.

Meanwhile, as shown in FIG. 1, the display system 100 according to the present disclosure may further include a reference color arrangement pattern determination unit 126 which determines a reference color arrangement pattern for correction of the compensation value. The reference color arrangement pattern determination unit 126 obtains measured values by inputting a test image to the display panel 110 including the previous sub-pixel and the current sub-pixel. When there are the measured values spaced apart from reference values among the obtained measured values on the predetermined color coordinates, the reference color arrangement pattern determination unit 126 may generate a reference color arrangement pattern based on a color arrangement corresponding to a region where measured values spaced apart from the reference values are disposed on the color coordinates.

Figure 7A:
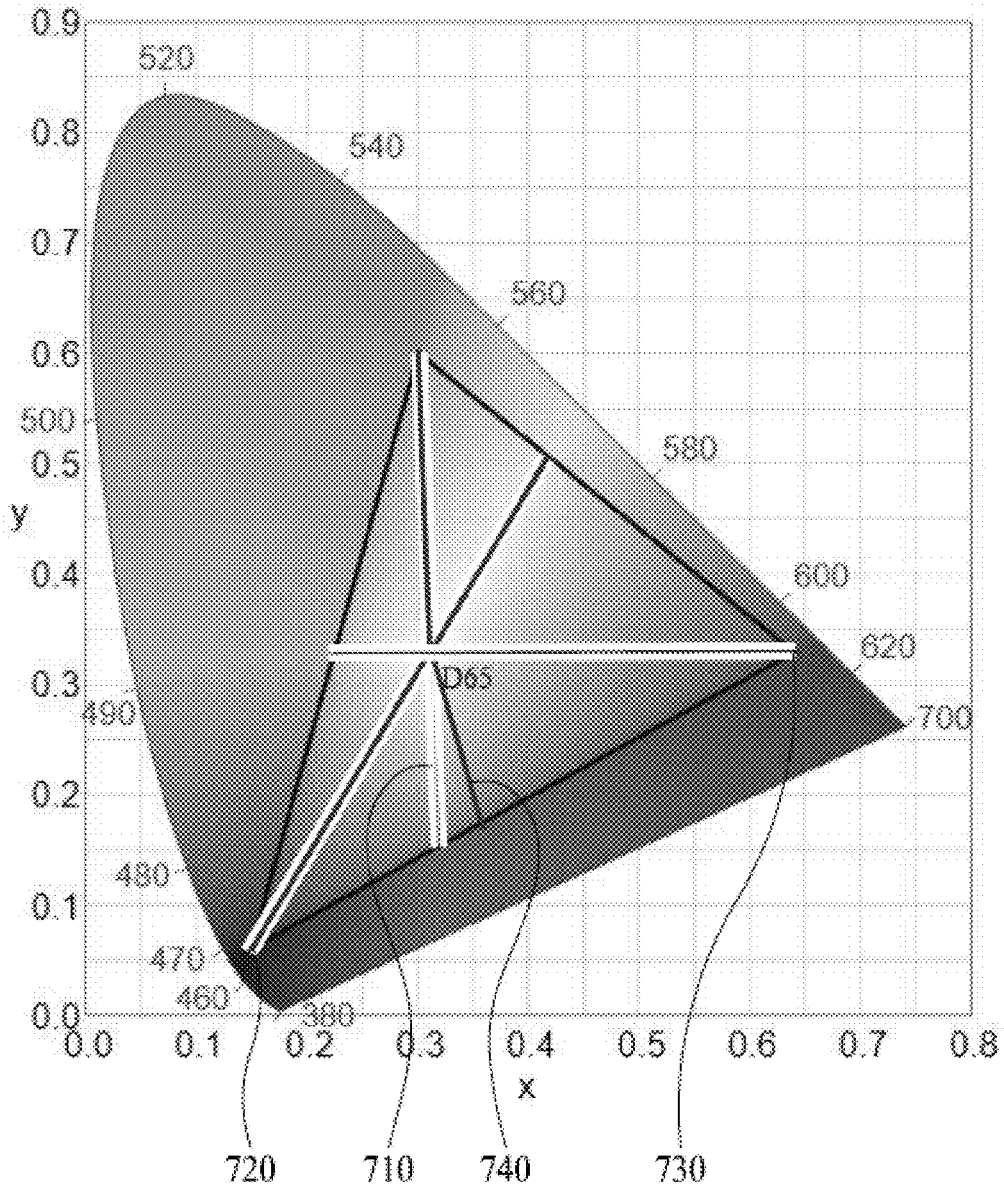
FIGS. 7A and 7B are diagrams conceptually illustrating a method in which a reference color arrangement pattern determination unit according to the present disclosure determines a reference color arrangement pattern.

For example, as shown in FIG. 7A, on the color coordinates, the reference color arrangement pattern determination unit 126 may determine a color arrangement in which a first color is changed to a second color as the reference color arrangement pattern when reference values 710 are located in a region between first coordinate values 720 for the first color and second coordinate values 730 for the second color and measured values 740 spaced apart from the reference values 710 are located in a region between the reference values 710 and the second coordinate values 730.

According to this example, the above-described correction determination unit 250 may determine that the color arrangement pattern corresponds to the reference color arrangement pattern when the color of the previous sub-pixel is the first color and the color of the current sub-pixel is the second color, and the overdriving pixel data generator 260 may determine a weight so that the overdriving pixel data becomes smaller than the second pixel data.

Figure 7B:
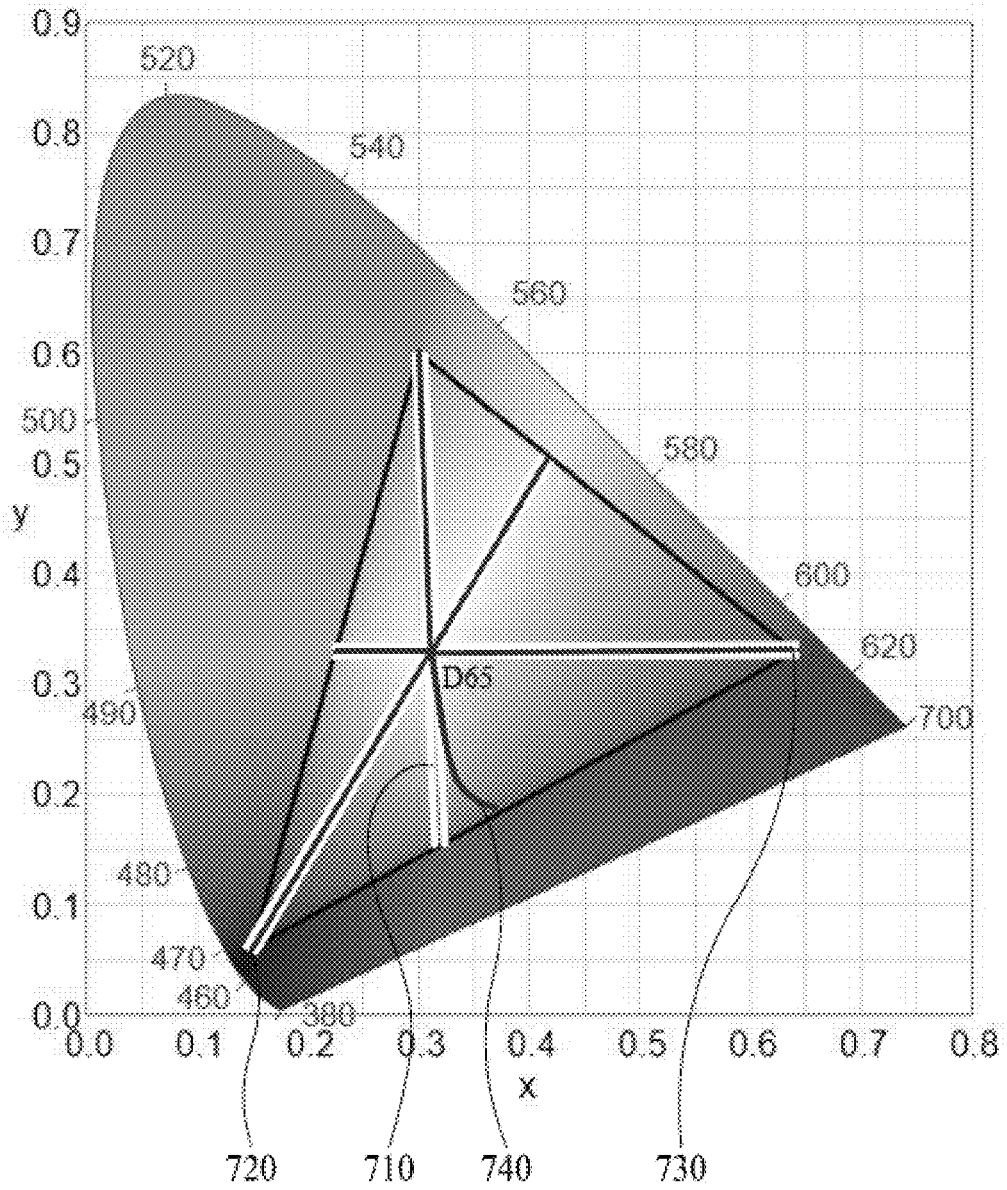

Meanwhile, as shown in FIG. 7B, on the color coordinates, when the reference values 710 are located in a region between the first coordinate values 720 for the first color and the second coordinate values 730 for the second color, and measured values 740 spaced apart from the reference values 710 are located in the region between the reference values 710 and the second coordinate values 730, and the spaced-apart measured values 740 are changed in a curved shape, the reference color arrangement pattern determination unit 126 may transmit the characteristics of the display panel 110 to the overdriving pixel data generator 260 through the timing controller 122. Thus, as described above, the overdriving pixel data generator 260 may change the weight according to the difference value between the first pixel data and the second pixel data.

Referring to FIG. 1 again, the data driver 140 converts the aligned pixel data Idata or the aligned overdriving pixel data Idata' output from the timing controller 122 to the source signal which is an analog signal according to the data control signal DCS supplied from the timing controller 122, and then supplies the source signal to the data lines DL1 to DLm to which the corresponding sub-pixels are connected. In this case, the data driver 140 supplies the source signal for one horizontal line to the data lines DL1 to DLm every one horizontal period in which the scan pulse is supplied to the gate lines GL1 to GLn.

Specifically, the data driver 140 selects a gamma voltage having a predetermined level according to a gray scale value of the pixel data or overdriving pixel data and supplies the selected gamma voltage to the data lines DL1 to DLm.

As shown in the drawings, the data driver 140 may be disposed at one side, for example, at an upper side of the display panel 110, but in some cases, may also be disposed at both one side and the other side facing each other, for example, the upper and lower sides of the display panel 110. The data driver 140 may include a plurality of source driver ICs. The data driver 140 may be formed in a shape of a tape carrier package in which the source driver ICs are mounted, but is not limited thereto.

In one embodiment, the source driver IC may include a shift register, a latch, a digital analog converter (DAC), and an output buffer. Further, the source driver IC may further include a level shifter for shifting a voltage level of pixel data or overdriving pixel data output from the timing controller 122 to a desired voltage level.

The gate driver 150 includes a shift register which sequentially generates the scan pulse, that is, a gate high pulse, in response to a gate start pulse (GSP) and a gate shift clock (GSC) among the gate control signals GCS from the timing controller 122. In response to this scan pulse, the thin film transistor TFT is turned on.

As shown in the drawings, the gate driver 150 may be disposed at one side, for example, a left side of the display panel 110, but in some cases, may also be disposed at both one side and the other side facing each other, for example, the left and right sides of the display panel 110. The gate driver 150 may include a plurality of gate driver ICs. The gate driver 150 may be formed in a shape of a tape carrier package in which the gate driver ICs are mounted, but is not limited thereto, and the gate driver ICs may be directly mounted on the display panel 110.

Hereinafter, a method for driving a display according to the present disclosure will be described with reference to FIG. 8.

Figure 8:
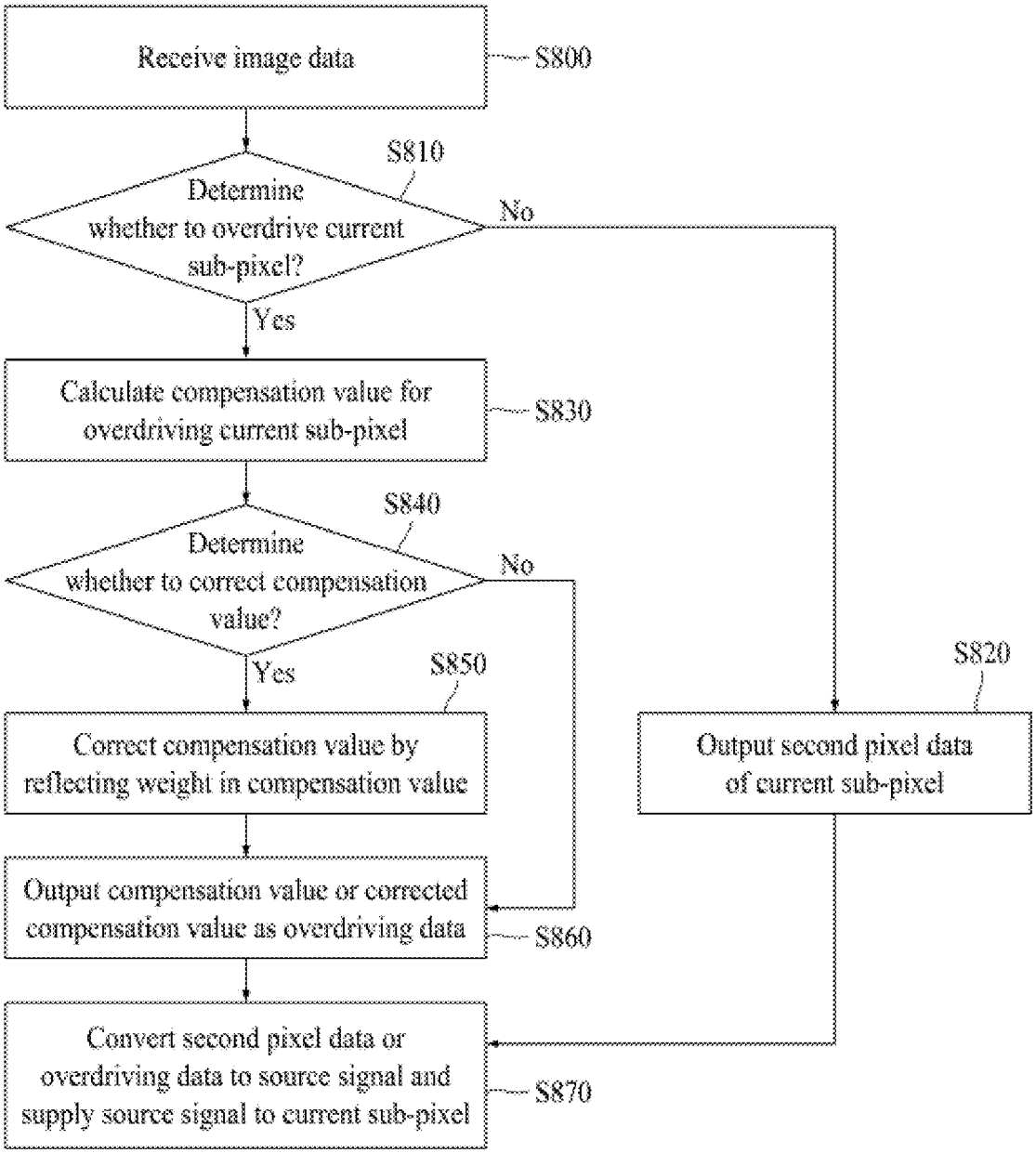
FIG. 8 is a flow chart illustrating a method for driving a display according to one embodiment of the present disclosure.

FIG. 8 is a flow chart illustrating a method for driving a display according to one embodiment of the present disclosure. The method for driving a display shown in FIG. 8 may be performed by the display system shown in FIG. 1.

First, a display driving device receives the image data from an external system (S800). In one embodiment, the display driving device may receive a still image as image data. The display driving device may classify the received image data in units of horizontal lines, and store the horizontal line data, which is the image data for one horizontal line, in a line memory.

Hereinafter, the display driving device determines whether to overdrive a current sub-pixel by comparing first pixel data for a previous sub-pixel with second pixel data for the current sub-pixel in units of the horizontal lines of the image data (S810).

Specifically, the display driving device compares the first pixel data for the previous sub-pixel included in a previous horizontal line and the second pixel data for the current sub-pixel included in a current horizontal line, and calculates a difference value between the first pixel data and the second pixel data. In this case, the previous sub-pixel and the current sub-pixel refer to pixels connected to the same data line in the previous horizontal line and the current horizontal line.

When the difference value between the first pixel data and the second pixel data is greater than a threshold value, the display driving device determines to overdrive the current sub-pixel, and when the difference value between the first pixel data and the second pixel data is smaller than or equal to the threshold value, the display driving device determines not to overdrive the current sub-pixel.

When it is determined not to overdrive the current sub-pixel in S810, the display driving device outputs the second pixel data which is the pixel data for the current sub-pixel to a data driver (S820).

Meanwhile, when it is determined to overdrive the current sub-pixel in S810, the display driving device calculates a compensation value for overdriving the current sub-pixel (S830). In one embodiment, the display driving device may determine a value mapped to a value for the first pixel data of the previous sub-pixel and a value for the second pixel data of the current sub-pixel on a lookup table as the compensation value for overdriving the current sub-pixel.

In the above-described embodiment, when there are no values for the first pixel data and the second pixel data on the lookup table, the display driving device may determine the value mapped to the value for the first pixel data and the value for the second pixel data using an interpolation method. That is, the display driving device may determine the compensation value for the current sub-pixel using values mapped to values adjacent to each of the value for first pixel data and the value for the second pixel data on the lookup table.

Hereinafter, the display driving device determines whether to correct the compensation value calculated in S830 based on a color arrangement pattern of the previous sub-pixel and the current sub-pixel (S840).

In one embodiment, the display driving device determines to correct the compensation value determined in S830 when the color arrangement pattern of the previous sub-pixel and the current sub-pixel corresponds to the predetermined reference color arrangement pattern. On the other hand, the display driving device determines not to correct the compensation value determined in S830 when the color arrangement pattern of the previous sub-pixel and the current sub-pixel does not correspond to the predetermined reference color arrangement pattern When it is determined to correct the compensation value in S840, the display driving device corrects the compensation value by reflecting a predetermined weight in the compensation value determined in S830 (S850).

In one embodiment, the display driving device may vary the weight to be applied to the compensation value for the current sub-pixel according to the difference value between the first pixel data and the second pixel data. Accordingly, since the weight to be reflected in the compensation value according to the difference value between the first pixel data and the second pixel data is varied, and thus a correction degree of the compensation value may be changed according to the difference value between the first pixel data and the second pixel data, the overdriving compensation accuracy of the current sub-pixel may be enhanced.

Meanwhile, when it is determined not to correct the compensation value in S840 or the compensation value is corrected in S850, the display driving device generates the compensation value determined in S830 or the compensation value corrected in S850 as the overdriving pixel data to output the overdriving pixel data to the data driver (S860).

Hereinafter, the data driver converts the second pixel data or the overdriving pixel data to a source signal and supplies the source signal to the corresponding pixel so that the image data is displayed on the display panel (S870).

Meanwhile, although not shown in FIG. 8, the display system according to the present disclosure may further include an operation of determining the reference color arrangement pattern. Specifically, the display system obtains measured values by inputting a test image to the display panel including the previous sub-pixel and the current sub-pixel. Thereafter, when there are measured values spaced apart from reference values among the measured values on a predetermined color coordinates, the display system may generate the reference color arrangement pattern based on a color arrangement corresponding to a region where the measured values spaced apart from the reference values are disposed on the color coordinates For example, as shown in FIG. 7A or 7B, the display system may determine a color arrangement in which a first color is changed to a second color as the reference color arrangement pattern when reference values 710 are located in a region between first coordinate values 720 for the first color and second coordinate values 730 for the second color and measured values 740 spaced apart from reference values are located in a region between the reference values 710 and the second coordinate values 730 on the color coordinates.

According to the present disclosure, since overdriving compensation can be performed for image data in units of horizontal lines, there is an effect in that the overdriving compensation can be performed for not only moving images but also still images.

Further, according to the present disclosure, since a compensation value recorded in a lookup table can be corrected according to a color arrangement pattern of a previous sub-pixel and a current sub-pixel, the overdriving compensation can be performed with only one lookup table, and thus there is an effect that manufacturing costs and size of a display device can be reduced, and at the same time, an occurrence of color distortion can be prevented by correcting the compensation value for a corresponding color even when a specific color change occurs in a display panel.

In addition, according to the present disclosure, even in the same color arrangement pattern, compensation accuracy can be enhanced by setting different weights to be applied to the compensation value recorded in the lookup table according to a difference value between pixel data of the previous sub-pixel and pixel data of the current sub-pixel.

It should be understood by those skilled in the art that the present disclosure can be embodied in other specific forms without changing the technical concept and essential features of the present disclosure.

All disclosed methods and procedures described herein may be implemented, at least in part, using one or more computer programs or components. These components may be provided as a series of computer instructions through any conventional computer-readable medium or machine-readable medium including volatile and nonvolatile memories such as random-access memories (RAMs), read only-memories (ROMs), flash memories, magnetic or optical disks, optical memories, or other storage media. The instructions may be provided as software or firmware, and may, in whole or in part, be implemented in a hardware configuration such as application-specific integrated circuits (ASICs), field-programmable gate arrays (FPGAs), digital signal processors (DSPs), or any other similar device. The instructions may be configured to be executed by one or more processors or other hardware configurations, and the processors or other hardware configurations are allowed to perform all or part of the methods and procedures disclosed herein when executing the series of computer instructions.

Therefore, the above-described embodiments should be understood to be exemplary and not limiting in every aspect. The scope of the present disclosure will be defined by the following claims rather than the above-detailed description, and all changes and modifications derived from the meaning and the scope of the claims and equivalents thereof should be understood as being included in the scope of the present disclosure.

What is claimed is:

1. A display driving device comprising:

an overdriving controller configured to generate overdriving pixel data for a current sub-pixel based on a result of comparison between first pixel data for a previous sub-pixel and second pixel data for the current sub-pixel and a color arrangement pattern of the previous sub-pixel and the current sub-pixel in units of horizontal lines of image data; and a data driver configured to generate a source signal for the current sub-pixel based on one of the second pixel data and the overdriving pixel data to supply the source signal to the current sub-pixel, wherein the current sub-pixel is a sub-pixel included in a first horizontal line which is a current horizontal line, the previous sub-pixel is a sub-pixel included in a second horizontal line immediately before the current horizontal line, and the previous sub-pixel and the current sub-pixel are connected to the same data line.

2. The display driving device of claim 1, wherein the overdriving controller comprises:

a compensation value calculation unit configured to calculate a difference value between the first pixel data and the second pixel data, and determine a compensation value using a value mapped to the first pixel data and the second pixel data on a lookup table when the difference value is greater than a threshold value;

a correction determination unit configured to detect the color arrangement pattern based on a color of the previous sub-pixel and a color of the current sub-pixel, and determine whether to correct the compensation value based on a result of comparison between the detected color arrangement pattern and a reference color arrangement pattern; and an overdriving pixel data generator configured to reflect a predetermined weight in the compensation value to generate the overdriving pixel data when it is determined to correct the compensation value.

3. The display driving device of claim 2, wherein the compensation value calculation unit outputs the second pixel data as the overdriving pixel data when the difference value is smaller than or equal to the threshold value, and wherein the overdrive pixel data generator outputs the compensation value determined by the compensation value calculation unit as the overdriving pixel data when it is determined not to correct the compensation value by the correction determination unit.

4. The display driving device of claim 2, wherein the overdriving pixel data generator varies the weight according to the difference value.

5. The display driving device of claim 2, further comprising a reference color arrangement pattern determination unit configured to determine the reference color arrangement pattern based on a color arrangement corresponding to a region where measured values spaced apart from reference values are located on color coordinates when there are the measured values spaced apart from the reference values on the color coordinates among values measured when a test image is input to a display panel including the previous sub-pixel and the current sub-pixel.

6. The display driving device of claim 5, wherein the reference color arrangement pattern determination unit determines a color arrangement in which a first color is changed to a second color as the reference color arrangement pattern when the reference values are located in a region between first coordinate values for the first color and second coordinate values for the second color on the color coordinates, and the measured values spaced apart from the reference values are located in a region between the reference values and the second coordinate values.

7. The display driving device of claim 6, wherein the correction determination unit determines that the color arrangement pattern corresponds to the reference color arrangement pattern when a color of the previous sub-pixel is the first color and a color of the current sub-pixel is the second color, and wherein the overdriving pixel data generator determines the weight so that the overdriving pixel data becomes smaller than the second pixel data.

8. The display driving device of claim 2, wherein, when the first pixel data and the second pixel data are not present on the lookup table, the compensation value calculation unit calculates the compensation value for overdriving the current sub-pixel using four values respectively mapped to third pixel data and fourth pixel data adjacent to the first pixel data and fifth pixel data and sixth pixel data adjacent to the second pixel data on the lookup table.

9. The display driving device of claim 2, wherein the overdriving controller further includes a line memory in which the image data is stored in units of the horizontal lines.

10. The display driving device of claim 9, wherein the line memory outputs the previously stored horizontal line data for the horizontal lines including previous sub-pixels to the compensation value calculation unit and the correction determination unit when the horizontal line data for current horizontal lines including the current sub-pixel are input from the outside and output to the compensation value calculation unit and the correction determination unit.

11. A method of driving a display, comprising:

comparing first pixel data for a previous sub-pixel and second pixel data for a current sub-pixel in units of horizontal lines of image data to determine whether to overdrive the current sub-pixel;

generating overdriving pixel data for the current sub-pixel based on a compensation value and a color arrangement pattern of the previous sub-pixel and the current sub-pixel when it is determined to overdrive the current sub-pixel, the compensation value being determined by using a value mapped to the first pixel data and the second pixel data on a lookup table; and converting one of the second pixel data and the overdriving pixel data to a source signal and outputting the source signal to the current sub-pixel, wherein the current sub-pixel is a sub-pixel included in a first horizontal line which is a current horizontal line, the previous sub-pixel is a sub-pixel included in a second horizontal line immediately before the current horizontal line, and the previous sub-pixel and the current sub-pixel are connected to the same data line.

12. The method of claim 11, further comprising comparing the color arrangement pattern and a reference color arrangement pattern to determine whether to correct the compensation value, wherein, when it is determined to correct the compensation value, the overdriving pixel data is generated by reflecting a predetermined weight in the compensation value, and wherein, when it is determined not to correct the compensation value, the compensation value is determined as the overdriving pixel data.

13. The method of claim 12, wherein the weight is varied according to a difference value between the first pixel data and the second pixel data.

14. The method of claim 12, further comprising determining the reference color arrangement pattern based on values measured when a test image is input to a display panel including the previous sub-pixel and the current sub-pixel, and wherein the reference color arrangement pattern is determined based on a color arrangement corresponding to a region where measured values spaced apart from reference values are located on color coordinates when there are the measured values spaced apart from the reference values on the color coordinates among the measured values.

15. The method of claim 14, wherein, when the reference values are located in a region between first coordinate values for a first color and second coordinate values for a second color on the color coordinates, and the measured values spaced apart from the reference values are located in a region between the reference values and the second coordinate values, a color arrangement in which the first color is changed to the second color is determined as the reference color arrangement pattern.

16. The method of claim 15, wherein it is determined that the color arrangement pattern corresponds to the reference color arrangement pattern if a color of the previous sub-pixel is the first color and a color of the current sub-pixel is the second color so that it is determined that the compensation value is to be corrected, and wherein the overdriving pixel data is generated to become smaller than the second pixel data.

17. The method of claim 11, wherein, when the first pixel data and the second pixel data are not present on the lookup table, the compensation value for overdriving the current sub-pixel is calculated by using four values respectively mapped to third pixel data and fourth pixel data adjacent to the first pixel data and fifth pixel data and sixth pixel data adjacent to the second pixel data on the lookup table.

* * * * *